US005873676A

United States Patent [19]

Brown

[11] Patent Number: 5,873,676

[45] Date of Patent: Feb. 23, 1999

[54] CORING ROD SUPPORT WHEEL

[76] Inventor: David M. Brown, 81 Lowson Crescent, Winnipeg Manitoba, Canada, R3P 0T3

[21] Appl. No.: 795,771

[22] Filed: Feb. 5, 1997

[51] Int. Cl.[6] ..... E02F 5/10; E21D 1/06

[52] U.S. Cl. ..... 405/184; 405/154; 175/53; 175/62

[58] Field of Search ..... 175/53, 325.5, 175/325.6, 325.7, 325.1, 62; 405/154, 138, 184; 299/31, 33

[56] References Cited

U.S. PATENT DOCUMENTS

| | | | |
|---|---|---|---|
| 1,518,370 | 12/1924 | Thomas | 175/325.5 |
| 2,499,252 | 2/1950 | Michael | 175/325.5 X |
| 2,529,246 | 11/1950 | Detrick | 175/325.5 X |
| 3,402,781 | 9/1968 | Sandberg | 175/62 X |
| 4,456,078 | 6/1984 | Adam | 175/53 X |

*Primary Examiner*—Tamara L. Graysay
*Assistant Examiner*—Jong-Suk Lee

[57] ABSTRACT

A coring rod support wheel that has a relatively large smooth outer surface and a hollow hub that is rigidly held within it. The axis of the hollow hub is parallel to the axis of the wheel but not necessarily the same as the axis of the wheel. The diameter of the hub is sufficient for a coring rod to slide freely through it. Once the coring rod has been slid through the hub, the coring rod any coring knife attached to it are supported and guided by the wheel.

8 Claims, 4 Drawing Sheets

CORING ROD SUPPORT WHEEL

BACKGROUND OF THE INVENTION

1. Field of the Invention

This invention relates to installing sections of horizontally laid underground piping using a coring rod to pull or push a coring knife horizontally through the site in which the piping is to be laid, and more specifically, to a device for supporting and guiding the coring rod and coring knife during tunnel diameter enlargement.

2. Description of Related Art

The Inventor has developed and patented methods and apparatuses for the laying of horizontally running underground piping, without having to first dig up the surface under which the piping will ultimately lie. Those methods and apparatuses are discussed and explained in U.S. Pat. Nos.: 5,498,106 and 5,505,558. The methods and apparatuses explained in said U.S.A. patents employ two pits. An entry pit on one side of the site under which the piping is to be laid, and an exit pit on the other side of the site under which the piping is to be laid.

In general terms, the method of installing horizontally laid piping underground, as taught by said U.S.A. patents, can be described as follows: An entry pit is dug on one side of the site under which the horizontally running underground piping is to be laid, and an exit pit is dug on the other side of the site under which the horizontally running underground piping is to be laid. From the entry pit, and at the correct depth, a pilot rod is pushed through the site into which the piping is to be laid, until the front end of that pilot rod emerges in the exit pit. Then, in the exit pit, two appropriately spaced and secured steering rods are attached near the front of the pilot rod, and one coring rod is attached near the front of the pilot rod, so that it is spaced and secured in the middle of the two steering rods. The pilot rod is then pulled back into the entry pit, causing the back end and length of the pilot rod to gradually emerge further and further into the entry pit, while simultaneously causing the three attached rods to enter deeper and deeper into the site, from their initial positions in the exit pit. The three attached rods create their own paths in the site as they are pulled through it toward the entry pit. Once the pilot rod has been pulled completely through the site, and is entirely in the entry pit, the other three rods have been pulled completely through the site, and are situated with their front ends in the entry pit, their lengths embedded in the site, and their back ends in the exit pit. Then, in the exit pit, a push-pull type coring knife is attached near the back end of the coring rod. Then, if the diameter of the piping to be laid, and if the soil of the site, is such that the tunnel can be dug with a single coring knife, and tunnel diameter enlargement will not be required, connecting a front cutting shield between the two steering rods, so that their back ends extend beyond the front cutting shield, and so that the front cutting shield is situated immediately behind the front cutting portion of the coring knife. Then placing a piece of the piping to be laid, inside the back of the front cutting shield so that it abuts the smaller internal diameter portion of the front cutting shield and cannot be moved forward without also moving the front cutting shield forward. Then placing a pulling cap over the back of the piece of pipe, so that its smaller internal diameter near its back edge abuts the back of the piece of pipe, and the pulling cap cannot be moved forward, without also moving the piece of pipe forward with it. Then attaching the pulling cap between the two steering rods, near their ends. Then by pulling the coring rod through the site, pulling the coring knife from the exit pit into and partly through the site, and pulling the two steering rods partly back through the site, thereby forcing the pulling cap, and the piece of pipe, and the front cutting shield partly through the site, behind the coring knife. Then continuing to pull the coring knife and the steering rods through the site, until the piece of pipe is entirely in the site. Then removing the pulling cap from the back of the piece of pipe, placing another piece of pipe immediately behind the inserted piece of pipe, so that it abuts up against its back end, and placing the pulling cap over the back of the second piece of pipe. Then again attaching the pulling cap, between the two steering rods, near their ends. Then pulling the coring knife further into the site, and pulling the two steering rods back through the site, thereby forcing the pulling cap, the two pieces of pipe, and the front cutting shield, further into the site, until the second piece of pipe is entirely in the site. Then again removing the pulling cap, adding another piece of pipe behind the second piece of pipe, again attaching the pulling cap behind the last piece of pipe, and again pulling the coring knife and steering rods further into the site. During the above process, removing the cored out soil from the back of the coring knife as necessary, either by pushing the coring knife back toward the exit pit, or by digging it out. Repeating the process of removing the pulling cap and adding new sections of piping, and then pulling them into the site, as the coring knife and the two steering rods are pulled further into the site, until the front cutting shield emerges into the open depression at the entry pit, and the piping has thereby been laid in the site. Then disconnecting the pulling cap from the steering rods, removing it from the back of the last piece of piping, pulling the steering rods out of the site, and removing the front cutting shield and coring knife.

However, in many situations the diameter of piping to be laid is to large for a large enough diameter tunnel to be dug, in the soil of the site, with a single coring knife. In those situations an initial tunnel is dug by using only a coring knife (without the pulling cap, or the sections of pipe, or the pipe installing apparatus) in the above described soil coring and pipe laying procedure. Then, after the initial tunnel has been dug, the coring rod is pushed back through the tunnel until its front end is in the exit pit. From the exit pit a first larger diameter coring knife is attached to the front end of the coring knife, and either the previously described pipe laying apparatus and procedure is employed, simultaneously with the digging of the larger diameter tunnel, or the larger diameter coring knife is pulled through the site by itself, thereby enlarging the diameter of the tunnel, and the coring rod is again pushed back through the tunnel until its front end is in the exit pit. From the exit pit a second larger diameter coring knife is attached to the front end of the coring rod, and the tunnel's diameter is enlarged a second time, or as the situations allows simultaneously with the second tunnel diameter enlargement, the previously described pipe laying process begins while the larger diameter tunnel is being dug.

As can be envisioned, whenever a tunnel diameter enlargement is taking place, whether it is with pipe being laid simultaneously, or it is simply in preparation for a second enlargement, when the front end of the coring rod with the coring knife attached is pushed entirely into the exit pit (as is necessary during the initial setup of the new coring knife, and during soil removal from the site by the pushing of the coring knife back into the exit pit) both the front end of the coring rod and the coring knife will fall to the bottom of the exit pit. When they fall to the bottom of the exit pit, the front end of the coring rod and the coring knife will dig into the bottom of the exit pit, and they will dig into the bottom end of the tunnel's exit pit opening. The coring rod and coring knife therefore have to be physically lifted up, and re-aligned with the central axis of the tunnel, before the coring rod can be pulled back through the site, to continue the pipe laying process.

One object of the present invention is to provide a means, which, during tunnel diameter enlargement, will substantially prevent the coring rod, and anything attached to it, from falling to the bottom of the exit pit each time the front end of the coring rod is pushed into the exit pit.

A second object of the present invention is to provide a means that will assist in maintaining the correct alignment of the coring rod and coring knife within the tunnel during tunnel diameter enlargement.

A third object of the present invention is to provide a means, that in certain of its embodiments, can assist in redefining the central axis of the tunnel during tunnel diameter enlargement.

A forth object of the present invention is to provide a means that accomplishes the other objects of the invention, and is durable.

A fifth object of the present invention is to provide a means that accomplishes the other objects of the invention, and is easy to use.

SUMMARY OF THE INVENTION

The objects of the invention are accomplished by a coring rod support wheel comprised of a main body that is cylinder like, and which has a relatively large smooth exterior surface, and a hollow hub rigidly supported within the main body, such that the longitudinal axis of the hollow hub is parallel with the longitudinal axis of the main body, and wherein the interior diameter of the hollow hub is greater than the exterior diameter of the coring rod with which the support wheel is intended to be used.

After a horizontal tunnel has been dug under a site in which piping is to be laid (which tunnel's diameter is not large enough to accommodate the required piping) and before the first larger coring knife is attached to the front end of the coring rod, which is in the exit pit, a coring rod support wheel is slid on to the front end of the coring rod, and is pushed into the tunnel near its exit pit opening. The outer diameter of the cylinder like main body of the coring rod support wheel is approximately the same as the diameter of the tunnel.

In situations where the initial tunnel is correctly oriented in the site, and therefore the enlarged diameter tunnel will have the same longitudinal axis as the initial tunnel, the coring rod support wheel will have a hollow hub with a longitudinal axis that is the same as the longitudinal axis of its cylinder like main body. Accordingly, the coring rod support wheel will hold the coring rod (and attached coring knife) substantially aligned on the path they should take through the tunnel, during the tunnel diameter enlargement. The reason, is that the coring rod support wheel takes up substantially all of the initial tunnel's diameter, and therefore it will be forced by the tunnel's wall to move along the path defined by the initial tunnel's central axis. Accordingly, a coring rod and coring knife, the centers of which must following the coring rod support wheel's central axis, will in most situations be forced, by the inability of the coring rod support wheel to deviate from the path of the initial tunnel's central axis, to also follow the path of the initial tunnel's central axis.

In situations where the initial tunnel is not correctly oriented in the site, and therefore the enlarged diameter tunnel should have a different longitudinal axis than the initial tunnel, the coring rod support wheel will have a hollow hub with a longitudinal axis that is parallel to, but not the same as, the longitudinal axis of its cylinder like main body. Accordingly, the hub of the coring rod support wheel will hold the coring rod (and attached coring knife) substantially aligned on the path they should take through the tunnel during the tunnel diameter enlargement (by the appropriate selection of the location of the longitudinal axis of the hub). The reason, is that the coring rod support wheel takes up substantially all of the initial tunnel's diameter, and therefore it will be forced by the tunnel's wall to move along the path defined by the initial tunnel's central axis. Accordingly, a coring rod and coring knife, the centers of which must following a non-central point within the coring rod support wheel, will in most situations be forced, by the inability of the coring rod support wheel to deviate from the path of the tunnel's central axis, to follow a path different from that of the initial tunnel's central axis, and which path is defined by the point within the coring rod support wheel that they must follow, and which path will be the longitudinal axis of the enlarged diameter tunnel.

DESCRIPTION OF THE PREFERRED EMBODIMENT

Figure 1:
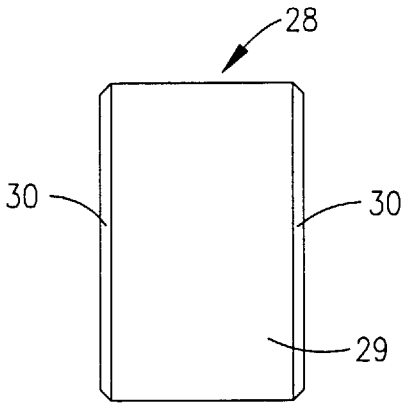
FIG. 1 is a front view of a preferred embodiment of a coring rod support wheel.
Figure 2:
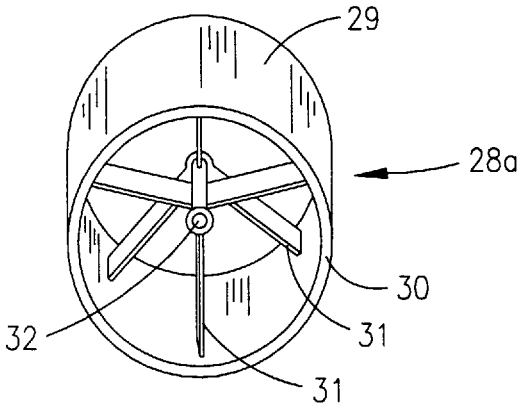
FIG. 2 is a perspective view of a preferred embodiment of a coring rod support wheel.
Figure 3:
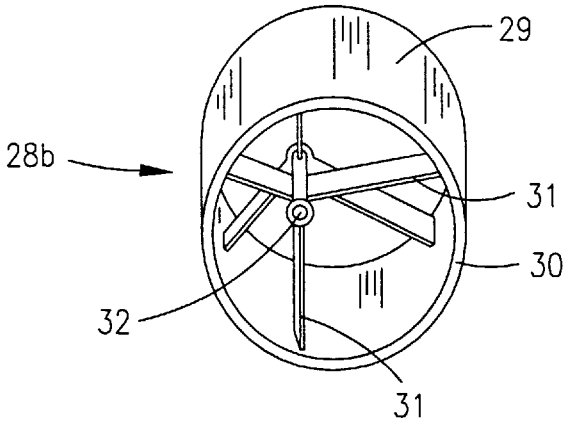
FIG. 3 is a perspective view of a preferred embodiment of a re-aligning coring rod support wheel.

FIGS. 1, 2 and 3 illustrate the preferred embodiment of the coring rod support wheel of the invention. In the preferred embodiment, the main body of the coring rod support wheel is a cylinder with a smooth, flat, and relatively large exterior surface 29. However, the main body of the invention does not have to be a cylinder, as long as it is cylinder like, and has a smooth, flat, and relatively large exterior surface, it will suffice. For example, a cylinder like main body having a substantially square cross section could be used in a non-preferred embodiment of the invention.

In the preferred embodiment illustrated in FIGS. 1, 2 and 3, the outer portions 30, of the exterior surface 29, are curved to form an angle of more than 180 degrees with the larger central portion of the exterior surface 29. The preferred embodiment is also made up of a hollow hub 32, with an interior diameter that is minimally larger than the exterior diameter of the coring rod it is meant to be used with. In all embodiments of the invention the hollow hub is held within the main body such that the longitudinal axis of the hollow hub is parallel with the longitudinal axis of the main body. The preferred embodiment is finally additionally made up of a multiple of rigid support arms 31, which are rigidly attached to the inside of the main body, and rigidly attached to the outside of the hollow hub, in a spoke like fashion, thereby rigidly holding the hollow hub 32 within the main body. In non-preferred embodiments of the invention, a spoke like configuration of support arms is not necessary, all that is necessary is that the hollow hub 32 be rigidly held within the main body such that the longitudinal axis of the hollow hub is parallel with the longitudinal axis of the main body. For example, flat walls between the hub and the interior of the main body could hold the hub in place. Another example would be if concentric rings were used to hold the hub to the main body.

FIG. 2 illustrates a coring rod support wheel 28*a* for use when the longitudinal axis of the initial tunnel is correct, and the enlarged diameter tunnel should have the same longitudinal axis as the initial tunnel. The hollow hub 32 of the coring rod support wheel 28*a* is slid over the coring rod, and the coring rod support wheel is placed in the tunnel, near the tunnel's opening into the exit pit. Accordingly, the hub of the coring rod support wheel will hold the coring rod (and when it is attached, the coring knife) substantially aligned on the path it should take through the tunnel, during the tunnel diameter enlargement.

FIG. 3 illustrates a coring rod support wheel 28*b* for use where the longitudinal axis of the initial tunnel is not correct, and the enlarged diameter tunnel should have a different longitudinal axis than the initial tunnel. The hollow hub 32 of the coring rod support wheel 28*b* is slid over the coring rod, and the coring rod support wheel is placed in the tunnel near the tunnel's opening into the exit pit. Accordingly, the hub of the coring rod support wheel will hold the coring rod (and when it is attached, the coring knife) substantially aligned on the path it should take through the tunnel, during the tunnel diameter enlargement.

Figure 4:
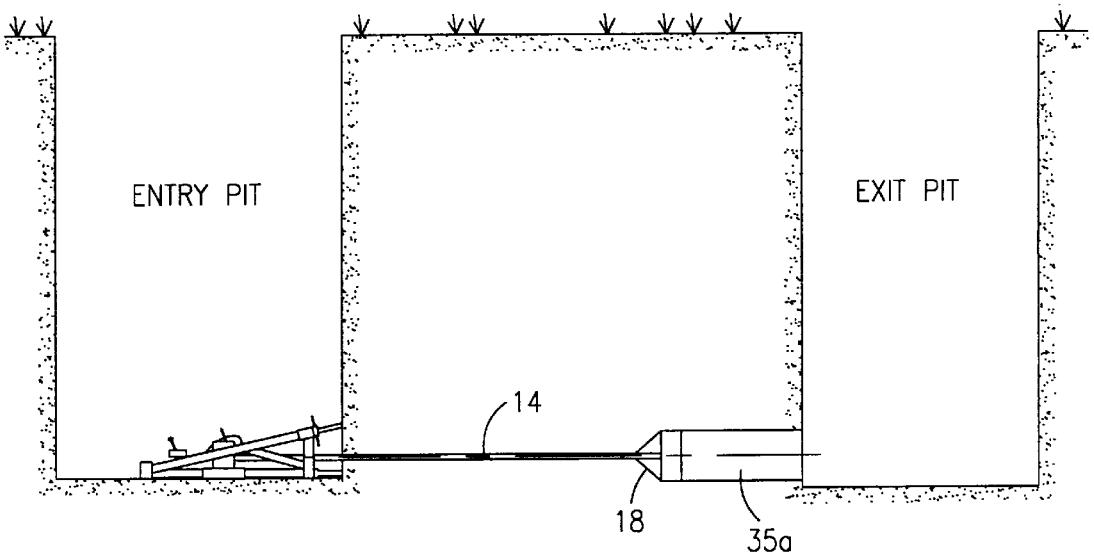
FIG. 4 is a diagram of the entry of the coring knife, beneath the site, beginning to create the tunnel for the piping.

FIG. 4 illustrates a coring rod 14 pulling a coring knife through the site into which the horizontal underground piping is to be laid, to create the initial tunnel 35*a*. As explained above, in some situations the initial tunnel 35*a* will not be of a large enough diameter for the desired piping. Sometimes the reason that the initial tunnel is not of a sufficient diameter is that the soil of the site limits how wide an initial tunnel can be cored through the site. other times, it is simply that the piping to be laid is of such a wide diameter that regardless of the soil, that diameter of tunnel could not be cored initially through the site.

Figure 9:
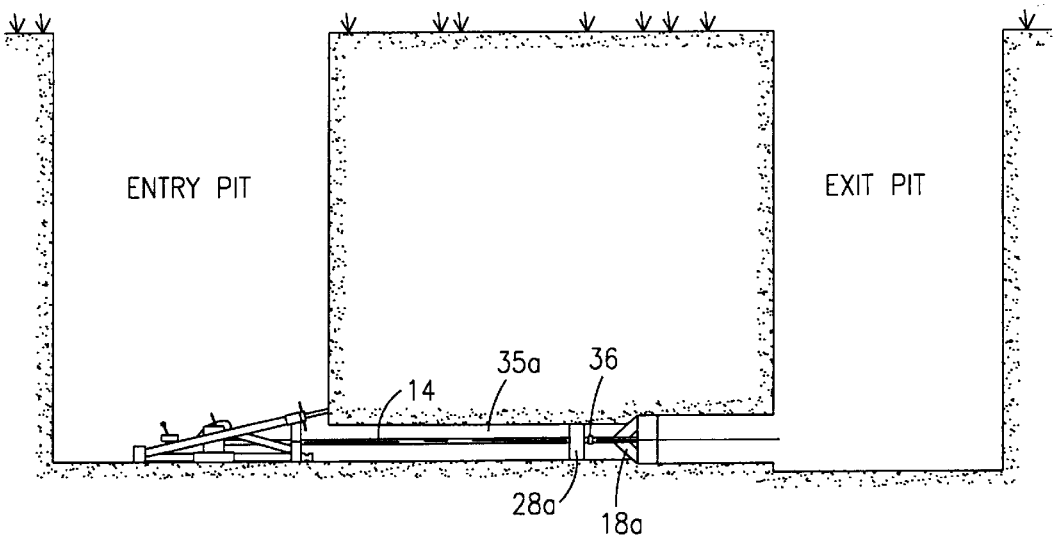
FIG. 9 is a diagram of the coring rod support wheel attached to the coring rod, and showing the coring rod and the coring knife being pulled back toward the entry pit, to enlarge the diameter of the initial tunnel.

If, after tunnel 35*a* is completed, it is lying correctly oriented within the site, and the tunnel required for the piping is wider than tunnel 35*a,* then a coring rod support wheel such as 28*a,* would be used in a manner such as illustrated in FIG. 9.

Figure 5:
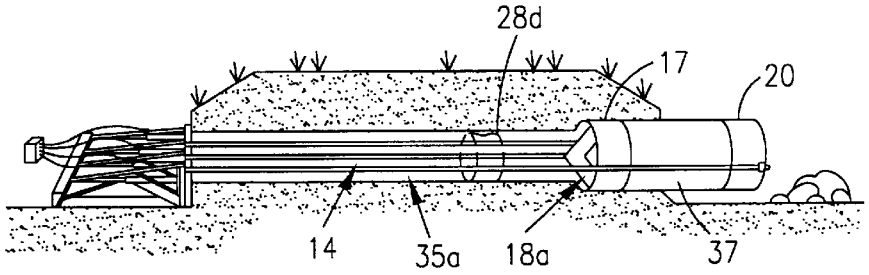
FIG. 5 is a diagram of the entry of the coring knife, with a front cutting shield, first section of piping, and the pulling cap, into the site, in which the piping is to be laid.
Figure 6:
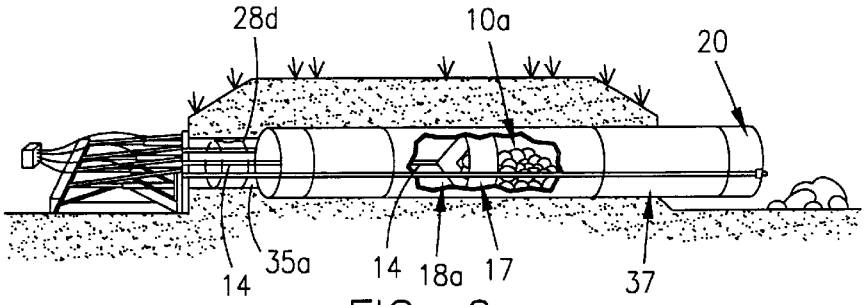
FIG. 6 is a diagram of the coring rod pushing the coring knife toward the exit pit, to clear the cored earth from the tunnel.

In FIG. 9, coring knife 18*a,* which is of a larger diameter than was the coring knife 18 used in FIG. 4, is being used without the piping and pipe laying apparatus illustrated in FIGS. 5 and 6, to enlarge the diameter of the tunnel 35*a*. As can be seen in FIG. 9, coring rod 14 is being supported by coring rod support wheel 28*a,* with the preferred embodiment of the coring rod support wheel illustrated in FIGS. 8, 9 and 10, a locking clamp is also being used, as illustrated at 36.

The locking clamp as illustrated at 36 can be anything which may be securely fastened to or around the coring rod 14, and which is too large to slide through the hollow hub 32 of the coring rod support wheel. In the preferred embodiment the locking clamp is a cylindrical collar with a threaded opening through its surface into which a bolt is tightened against the coring rod 14. The interior diameter of the threaded collar is larger than the exterior diameter of the coring rod 14, and the exterior diameter of the cylindrical collar is larger than the interior diameter of the hollow hub 32. The purpose of the locking clamp is to prevent the coring rod from accidentally being slid out of the hub 32, and to assist in preventing the coring rod support wheel from accidentally being pushed into the exit pit.

Figure 7:
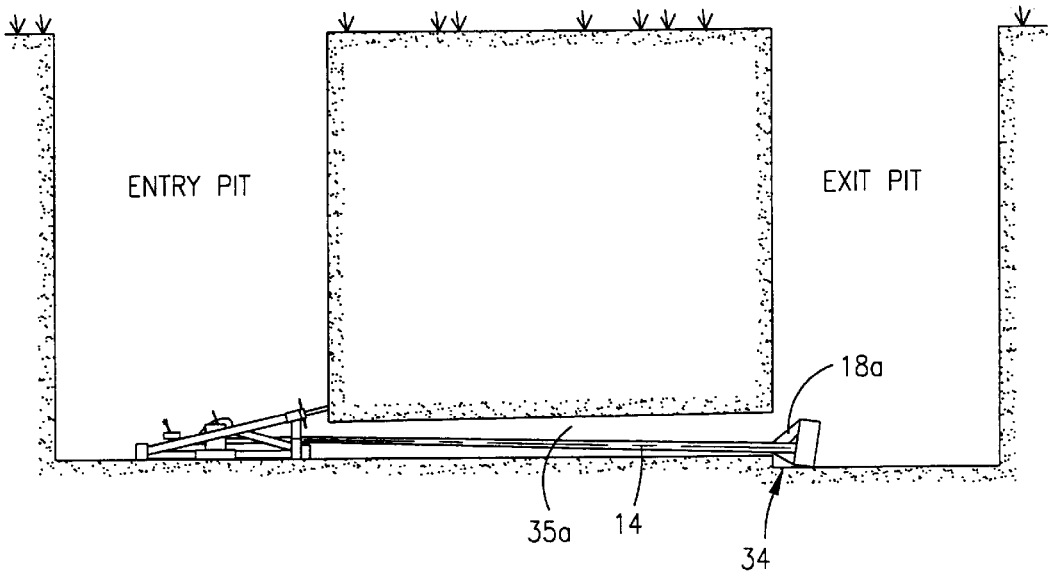
FIG. 7 is a diagram of the coring rod and coring knife lying at the bottom of the exit pit.

FIG. 7 illustrates the position in the exit pit that the coring rod's front end, and the attached coring knife, would normally occupy in the exit pit, prior to a tunnel diameter enlargement beginning. It can be seen at 34 of FIG. 7, that the front end of the coring rod, and the coring knife, have fallen to the bottom of the exit pit, and unless manpower is employed to raise them so that they are aligned with the tunnel, when the coring rod is pulled back toward the entry pit, the coring knife is going to dig into the bottom of the tunnel's opening into the exit pit. If the coring knife digs into the tunnel's opening into the exit pit, it may become jammed, or it may alter the orientation of the larger diameter tunnel which it is digging. Each time the coring knife is pushed back into the exit pit, to empty cored soil from the tunnel, the same set of potential problems will develop, as the coring rod's front end, and the attached coring knife will fall to the bottom of the exit pit. Accordingly, manpower is needed each time the coring rod and coring knife are again going to be pulled back out of the exit pit, to lift the coring knife and the front end of the coring rod, and align them with the tunnel that is being cored.

Figure 8:
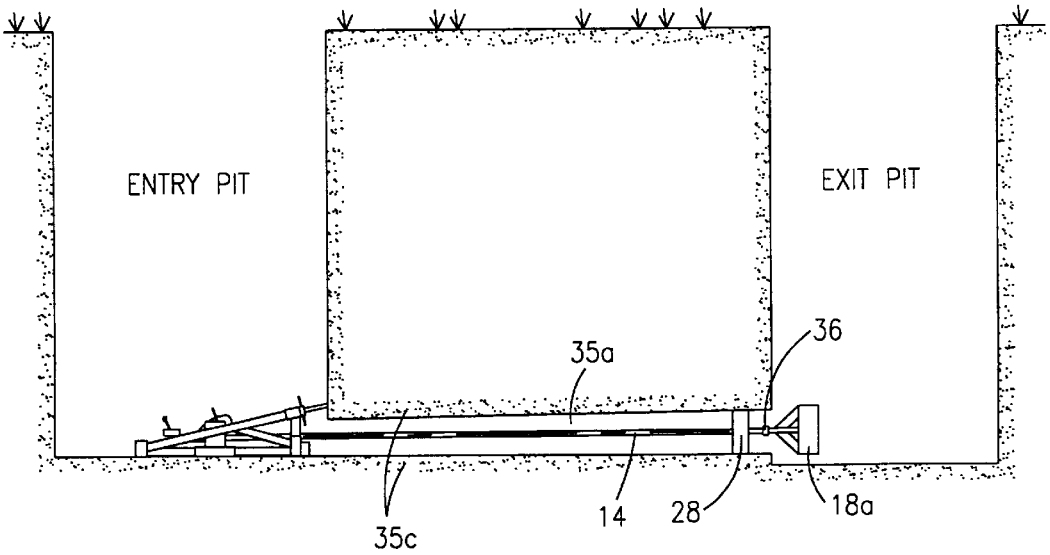
FIG. 8 is a diagram of a coring rod support wheel attached to the coring rod, and showing the coring rod and the coring knife remaining aligned with the tunnel.

FIG. 8 illustrates the position in the exit pit a coring rod's front end and the attached coring knife will occupy with the use of any coring rod support wheel 28. Because the orientation of the initial tunnel 35*a,* within the site, is correct, a coring rod support wheel such as 28*a* of FIG. 9, with a central hollow hub, is being used in the FIG. 9 example. The dashed lines 35*c* of FIG. 8 indicate the diameter that the tunnel will be once it has been enlarged by the coring knife 18*a,* which is of a larger diameter than was coring knife 18. It can be easily seen that with the coring rod support wheel in place, the path which the coring rod and coring knife will follow will be in alignment with the initial tunnel 35*a*. If obstructions are encountered in the soil being cored out around the initial tunnel 35*a,* they would tend to cause the coring knife to deviate from its desired path. The reason, is that in a FIG. 7 set up, where there is no coring rod support wheel, it is only the wall of the tunnel that is holding the coring knife in place. Accordingly, if a large rock is lodged in a portion of that tunnel wall, or Just behind that tunnel wall, when the coring knife hits that rock, the part of the coring knife that is in contact with the lodged rock will require a greater force to pass through the rock, than the force required by the remainder of the coring knife, which is in contact with the normal soil to be found in the site, and therefore only requires enough force to pass through the normal site soil. However, as the coring knife is being pulled by the coring rod with equal force at all of its tunnel wall contact points, in many instances the force of the coring knife at the rock will not be sufficient to cause the coring knife to go through the rock, or to push the rock out of the way, and consequently the coring knife will be veered off of its correct path of travel by the rock, which may cause the coring knife to re-orient itself within the tunnel, and continue coring along an altered path, thereby causing the resultant larger diameter tunnel to be wrongly oriented within the site. However, with the coring rod support wheel in place, an extremely large amount of force is required to cause it to deviate from the path of travel defined by the original tunnel. The reason, is that the coring rod support wheel is in contact with the tunnel's wall, or minimally within the tunnel's wall; and it travels in front of the coring knife, therefore, for the coring knife to deviate from the tunnel's defined path, first the coring rod support wheel must be made to deviate from the tunnel's defined path. However, as the coring rod support wheel is constantly presenting a large surface area to all points of the tunnel's wall, a very large amount of force would be required to cause the coring rod support wheel to break through the tunnel's wall. In most instances the amount of force required to cause the coring rod support wheel to break through the tunnel's wall would be greater than the force required to cause the coring knife to break through the lodged obstruction, or to dislodge the lodged obstruction. Accordingly, what happens, is that the coring knife halts in its original path of travel, until a great enough pulling force has been built up on the coring rod to cause the coring knife to either: (a) break through the lodged obstruction, or to dislodge the lodged obstruction; or (b) to cause the coring rod support wheel to break through the tunnel wall. However, in most cases as the force for (b) to occur is greater than the force required for (a) to occur, it is (a) that occurs first, as its necessary force threshold is reached before (b)'s, and therefore (a) can occur at a point in time at which (b) cannot yet occur.

Figure 10:
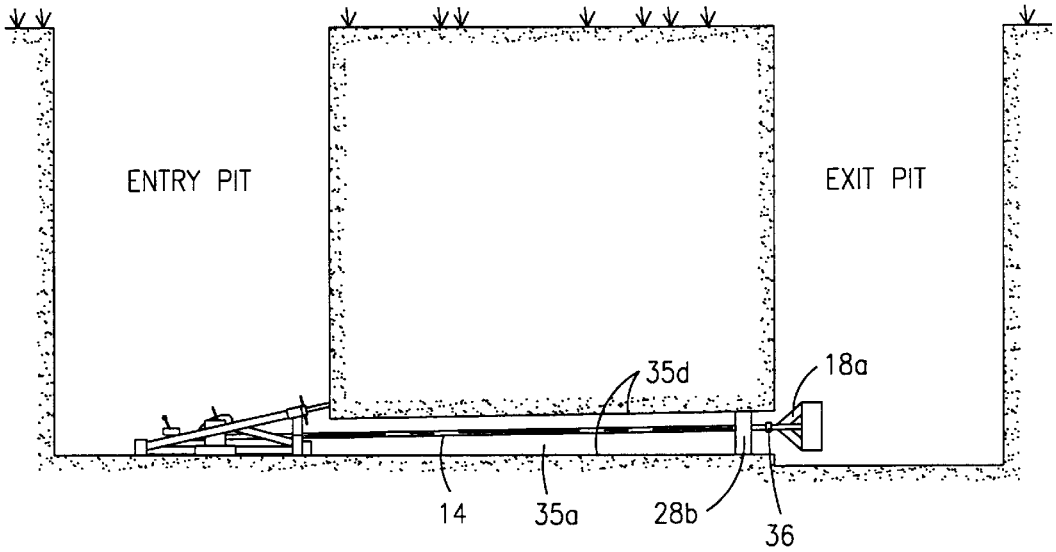
FIG. 10 is a diagram of a re-aligning coring rod support wheel attached to the coring rod, and showing the coring rod and the coring knife remaining aligned with the central axis of designated tunnel diameter enlargement, even though the coring knife is in the exit pit.

In situations where the longitudinal axis of the tunnel is not correct, and the enlarged diameter tunnel will have a different longitudinal axis than the initial tunnel, the coring rod support wheel will have a hollow hub with a longitudinal axis that is parallel to, but not the same as the longitudinal axis of its main body. Accordingly, the hub of the coring rod support wheel will hold the coring rod (and attached coring knife) substantially aligned on the path it should take through the tunnel, as illustrated in FIG. 10, where the dashed lines 35*d* indicate the correct orientation for the enlarged diameter tunnel which is to be cored. In FIG. 10 it can be seen that the coring rod support wheel, with its off-center hub, is holding the coring rod and attached coring knife above and at an angle to the longitudinal axis of the initial tunnel 35*a*; anti will continue to do so as the coring rod support wheel travels within initial tunnel 35*a* for the entire tunnel diameter enlargement. The reason, is that the coring rod support wheel is in contact with the tunnel's wall, or slightly within the tunnel's wall; and it travels in front of the coring knife, therefore, for the coring knife to deviate from the path forced on it by its connection to the coring rod support wheel, first the coring rod support wheel must be made to deviate from the initial tunnel's defined path. However, as the coring rod support wheel is constantly presenting a large surface area to all points of the initial tunnel's wall, a very large amount of force would be required to cause the coring rod support wheel to break through the initial tunnel's wall. In most instances the amount of force required to cause the coring rod support wheel to break through the tunnel's wall would be greater than the force required to cause the coring knife to core through the additional earth it is being pulled through in its enlargement of initial tunnel 35*a*. Accordingly, what happens, is that the coring rod support wheel follows the path of the initial tunnel, and the coring knife follows the path forced on it by the coring rod support wheel.

FIGS. 5 and 6 illustrate the insertion of the piping into the site. The dashed lines 28*d* indicate where the coring rod support wheel would be located if one was being used. It can be seen in FIGS. 5 and 6, that if a coring rod support wheel is not being used, it is the wall of tunnel 35*a* (the tunnel which is being enlarged) that is the most significant factor which is holding the coring knife in place and guiding it.

In FIG. 5 the larger diameter coring knife 18*a* has begun to enter the initial tunnel 35*a*. Immediately behind the coring knife 18*a* is the front cutting shield 17. The initial piece of piping 37, which is to be laid, is inside the back of the front cutting shield so that it abuts the smaller internal diameter portion of the front cutting shield and cannot be moved forward without also moving the front cutting shield forward. A pulling cap 20 has been placed over the back of the piece of pipe 17, so that its smaller internal diameter near its back edge abuts the back of the piece of pipe, and the pulling cap cannot be moved forward, without also moving the piece of pipe forward with it. The pulling cap is attached between the two steering rods, near their ends. By pulling the coring rod through the site, which is pulling the coring knife from the exit pit into and partly through the site, and pulling the two steering rods partly back through the site, the pulling cap, and the piece of pipe, and the front cutting shield are forced partly through the site, behind the coring knife. The pulling of the coring knife and the steering rods through the site is continued until the piece of pipe is entirely in the site. The pulling cap is then removed from the back of the piece of pipe, another piece of pipe is placed immediately behind the inserted piece of pipe, so that it abuts up against its back end, and the pulling cap is placed over the back of the second piece of pipe. The pulling cap is then again attached between the two steering rods, near their ends. The coring knife is then pulled further into the site, as are the two steering rods, thereby forcing the pulling cap, the two pieces of pipe, and the front cutting shield, further into the site, until the second piece of pipe is entirely in the site.

FIG. 6 illustrates the process after the pulling cap has again been removed, and another piece of pipe 37 added behind the second piece of pipe, and the pulling cap is again attached behind the last piece of pipe.

FIG. 6 also illustrates the coring knife 18*a* being pushed back toward the exit pit to push out the cored soil.

The FIG. 5 and FIG. 6 described process is repeated until the front cutting shield emerges into the open depression at the entry pit, and the piping has thereby been laid in the site. Then the apparatus is disconnected from the laid piping, and the job of laying horizontal underground piping, under a site which has not been dug up, is complete. If the entry pit and the exit pit are not desired, they are simply filled in.

I claim:

1. A coring rod support wheel, for use with a coring rod which has a longitudinal axis, which coring rod support wheel is comprised of:

(i) a main body that is in the shape of a cylinder, which main body has a smooth exterior surface that is comprised of a larger central surface and two smaller outer surfaces, one of which borders the larger central surface along one of the ends of the larger central surface, and the other of which borders the larger central surface along the other of the ends of the larger central surface, wherein at each point where an outer surface meets said central surface an angle of greater than 180 degrees is formed between said outer surface and said central surface;

(ii) a hollow hub, the interior diameter of which is minimally larger than the exterior diameter of the coring rod that will be slid through the hollow hub;

(iii) a rigid hollow hub support means; and (iv) wherein the rigid hollow hub support means rigidly holds the hollow hub inside the main body, such that the longitudinal axis of the hollow hub is parallel with the longitudinal axis of the main body.

2. A coring rod support wheel as defined in claim 1 wherein the longitudinal axis of the hollow hub is the same as the longitudinal axis of the main body.

3. A coring rod support wheel as defined in claim 1 wherein the longitudinal axis of the hollow hub is not the same as the longitudinal axis of the main body.

4. A coring rod support wheel as defined in claim 1, wherein the rigid hollow hub support means is comprised of a multiple of rigid arms.

5. A coring rod support wheel as defined in claim 1, wherein the rigid hollow hub support means is comprised of a multiple of rigid arms, and wherein the longitudinal axis of the hollow hub is the same as the longitudinal axis of the main body.

6. A coring rod support wheel as defined in claim 1, wherein the rigid hollow hub support means is comprised of a multiple of rigid arms, and wherein the longitudinal axis of the hollow hub is not the same as the longitudinal axis of the main body.

7. A coring rod support wheel, for use with a coring rod which has a longitudinal axles which coring rod support wheel is comprised of:

(i) a main body that is in the shape of a cylinder, which main body has a smooth exterior surface;

(ii) a hollow hub, the interior diameter of which is minimally larger than the exterior diameter of the coring rod that will be slid through the hollow hub;

(iii) a rigid hollow hub support means; and (iv) wherein the rigid hollow hub support means rigidly holds the hollow hub inside the main body, such that the longitudinal axis of the hollow hub is parallel with the longitudinal axis of the main body; and (v) wherein the longitudinal axis of the hollow hub is not the same as the longitudinal axis of the main body.

8. A coring rod support wheel as defined in claim 7, wherein the rigid hollow hub support means is comprised of a multiple of rigid arms.

* * * * *